US006044650A

United States Patent [19]

Cook et al.

[11] Patent Number: 6,044,650

[45] Date of Patent: Apr. 4, 2000

[54] INSULATED STORAGE/SHIPPING CONTAINER FOR MAINTAINING A CONSTANT TEMPERATURE

[75] Inventors: Sanford L. Cook, Ocean; Joseph N. Villa, Hazlet; Katherine T. Cansfield, Milford; David J. Kenyon, Raritan, all of N.J.

[73] Assignee: TCP/Reliable Inc., Johnson & Johnson, Edison, N.J.

[21] Appl. No.: 08/910,392

[22] Filed: Aug. 13, 1997

Related U.S. Application Data

[63] Continuation-in-part of application No. 08/359,802, Dec. 20, 1994, abandoned.

[51] Int. Cl.[7] ..... F25D 3/08

[52] U.S. Cl. ..... 62/130; 62/457.2

[58] Field of Search ..... 62/125, 129, 130, 62/371, 372, 457.1, 457.2, 457.3, 457.5, 457.9, 530; 206/570; 116/219, 216, 217, 218

[56] References Cited

U.S. PATENT DOCUMENTS

| | | | |
|---|---|---|---|
| 634,070 | 10/1899 | Smith | 62/457.5 X |
| 1,963,743 | 6/1934 | Hoodless | 62/372 |
| 3,406,532 | 10/1968 | Rownd et al. | 62/457.5 X |
| 4,364,234 | 12/1982 | Reed | 62/130 X |
| 4,509,587 | 4/1985 | Clark et al. | 62/372 X |
| 5,058,397 | 10/1991 | MacDonald | 62/457.2 |
| 5,181,394 | 1/1993 | Schea, III et al. | 62/371 |
| 5,235,819 | 8/1993 | Bruce | 62/457.2 X |
| 5,435,142 | 7/1995 | Silber | 62/457.2 X |

FOREIGN PATENT DOCUMENTS

| | | | |
|---|---|---|---|
| 445335 | 11/1912 | France | 62/372 |

*Primary Examiner*—Harry B. Tanner
*Attorney, Agent, or Firm*—Jonathan B Schafrann

[57] ABSTRACT

A container is disclosed for storing and transporting vessels containing a liquid composition susceptible to physico-chemical alteration upon changes in temperature above or below a specified temperature. It comprises an enclosure having a lower portion, a top portion and a side portion between the lower and top portions thereby defining an inner space. A lower portion of the enclosure contains a first heat sink within a base, comprising a thermal energy absorbing substance. A vial holder in the inner space holds one or more of the vessels in the inner space above the first heat sink and substantially spaced from an insulated insert inside of the enclosure. An insulating gas is contained in the inner space. A temperature indicator in the inner space indicates when the inner space has been subjected to temperatures below a predetermined level.

37 Claims, 5 Drawing Sheets

INSULATED STORAGE/SHIPPING CONTAINER FOR MAINTAINING A CONSTANT TEMPERATURE

BACKGROUND

This is a continuation-in-part of application Ser. No. 08/359,802 filed Dec. 20, 1994 which is now abandoned.

FIELD OF THE INVENTION

The present invention relates generally to shipping and storing thermally sensitive materials such as biologically active proteins and medicaments, and more particularly to containers for maintaining such materials at an essentially constant temperature during transport and storage.

STATE OF THE PRIOR ART

With the recent development of recombinant DNA technologies, increasing numbers of biologically active materials such as peptides, proteins and glyco-proteins have become available for research and therapeutic use. These products have a significant potency and are frequently supplied as dilute aqueous solutions of the active ingredient combined with small quantities of pharmaceutically acceptable adjuvant and carrier substances such as serum albumin. It is believed that if the solution freezes, it can generate physicochemical alterations which are not spontaneously reversible upon thawing, such as formation of both lower and higher molecular weight species of the proteins. These changes could potentially affect the biological potency of the products which have been subjected to freezing. A common problem encountered with transporting and storing pharmaceuticals is to maintain the pharmaceutical preparation within a constant temperature range.

The prior art is rife with various container designs fashioned from polymer materials, alone or in combination with cardboard or particle-board boxes. Shipping boxes with insulated interiors run the gamut from ubiquitous "food-coolers" to esoteric single vessel transport units. For example, a cardboard box filled with foam peanuts surrounding a second cardboard box holding the medicament is but one common embodiment. Other examples are plastic containers which are filled with open cell or closed cell foam and contain a cutout adapted to receive a second box, the second box contains the medication. Still another commonly employed container is an inner vessel surrounded by a space which has been evacuated of air and surrounded by a second or outer wall (i.e. the Thermos® bottle).

Persons seeking to transport highly labile samples, which must be maintained in a frozen state, have used ice and dry-ice for maintaining temperatures sufficient to keep the samples in a frozen condition. Unfortunately, the use of dry-ice preparations are of limited utility due to rapid evaporation, and as well may be dangerous due to the release of carbon dioxide. The use of ice and dry-ice creates the untoward risk of introducing a toxic contaminant, or a pathogen.

Still, other transportable containers rely on refrigeration units to maintain sub-ambient conditions. With these systems a power failure, which might proceed undetected, could prove fatal to the efficacy of the preparation.

While most people are familiar with spoilage due to exposure to heat, or to sub-freezing temperatures, maintaining a constant temperature within ambient values is a highly desirable objective. There is a vast array of pharmaceutical preparations that must be maintained within an ambient temperature range. The preferred range is generally from about 40° to 80° Fahrenheit. Therefore, the container must prevent extreme changes in outside temperatures which are often encountered in shipping from affecting the preparation contained therein. A shipment of pharmaceuticals which is stored on the tarmac prior to loading on an aircraft must endure elevated temperatures for extended periods of time. On the other hand, once loaded in the aircraft the medicaments are often exposed to sub-freezing temperatures during flight.

The emphasis of prior art containers teaches the construction of containers for maintaining a payload at sub-ambient temperatures.

Schea, III et al. U.S. Pat. No. 5,181,394 issued Jan. 26, 1993 discloses a previous attempt to provide a shipping and storage container adapted to maintain vials of liquid in a refrigerated, but not frozen state. The container comprises an outer side wall having the shape of a rectangular open tray and an inner side wall having a number of wells to accommodate a number of vials. The inner and outer side walls are dimensioned and shaped to nest the inner side wall component within the outer side wall component. A phase change material comprising a freshly prepared mixture of water and 2% by weight self-gelling carboxymethylcellulose is provided between the inner and outer side walls. A freeze indicator is positioned within the container and exhibits a color change upon being subjected to temperatures below a predetermined level. The carboxymethylcellulose gel exhibits relatively poor insulating properties, and conducts heat from the vials.

U.S. Pat. No. 5,355,684 issued to Guice discloses a shipping container for the cryogenic shipping or storage of biologic materials. Further, this invention utilizes a plurality of "heat sinks" disposed within an insulated container. The heat sink material is preferably composed of a phase change material that is first frozen and as it thaws, absorbs free heat to keep the sample inside the vessel in a frozen condition.

U.S. Pat. No. 5,058,397 issued to MacDonald discloses a storage container where microcentrifuge tubes are embedded into a coolant matrix of gel. Overlying the embedded tubes is a gel contained in an envelope within a lid means which is comprised of an envelope of gel.

U.S. Pat. No. 4,250,998 issued to Taylor discloses a container for transporting insulin and syringes wherein there is an insulated container with a plurality of cavities. The inner cavities are to be filled with water for freezing, while the outer cavities are designed to house the syringes.

SUMMARY OF THE INVENTION

A container according to the present invention provides for storage and shipping of vessels containing a liquid composition susceptible to physicochemical alteration upon freezing or upon exposure to elevated temperatures. It comprises an enclosure created by an upstanding means. It is best illustrated by a plurality of upstanding walls where there are at least two pairs of opposing walls of essentially equal dimensions thereby defining an inner space. The base portion of the enclosure contains a first heat sink, comprising a thermal energy absorbing phase change material. A vial holder is disposed within the chamber and thereby divides the container into a bottom chamber and top chamber. The vial holder is adapted to hold one or more of the vials suspended within the bottom chamber and above the first heat sink. The vial holder possesses a like number of apertures therethrough so that the resulting array of apertures is essentially in an equidistant relation to one another.

A central aperture is disposed in an equidistant relationship relative to the other apertures. Within the central aperture there is a temperature indicator means disposed within a housing of a similar size and shape of the proposed sample containers which are to be disposed within the apertures to signal exposure to contraindicated temperatures. An insulating gas is contained in the inner space.

A lid may be introduced to seal the top chamber and provide closure to the container. The lid is removably retained and provides access for removal of the vessels held in the planar holder. Additionally, the lid houses a second heat sink which incorporates the same phase change material as in the first sink.

The vial holder is a thin planar panel, resides above the first heat sink and possesses at least one or more apertures for receiving the vials. The vial holder divides the container into top and bottom chambers. When in a closed condition, the vial holder retains the vials within the bottom chamber while a gas, namely air surrounds the vials.

BRIEF DESCRIPTION OF THE DRAWINGS

Further features, objects and advantages will become evident from the following detailed description of the preferred embodiments of the present invention taken in conjunction with the accompanying drawings, in which.

DETAILED DESCRIPTION

Figure 1:
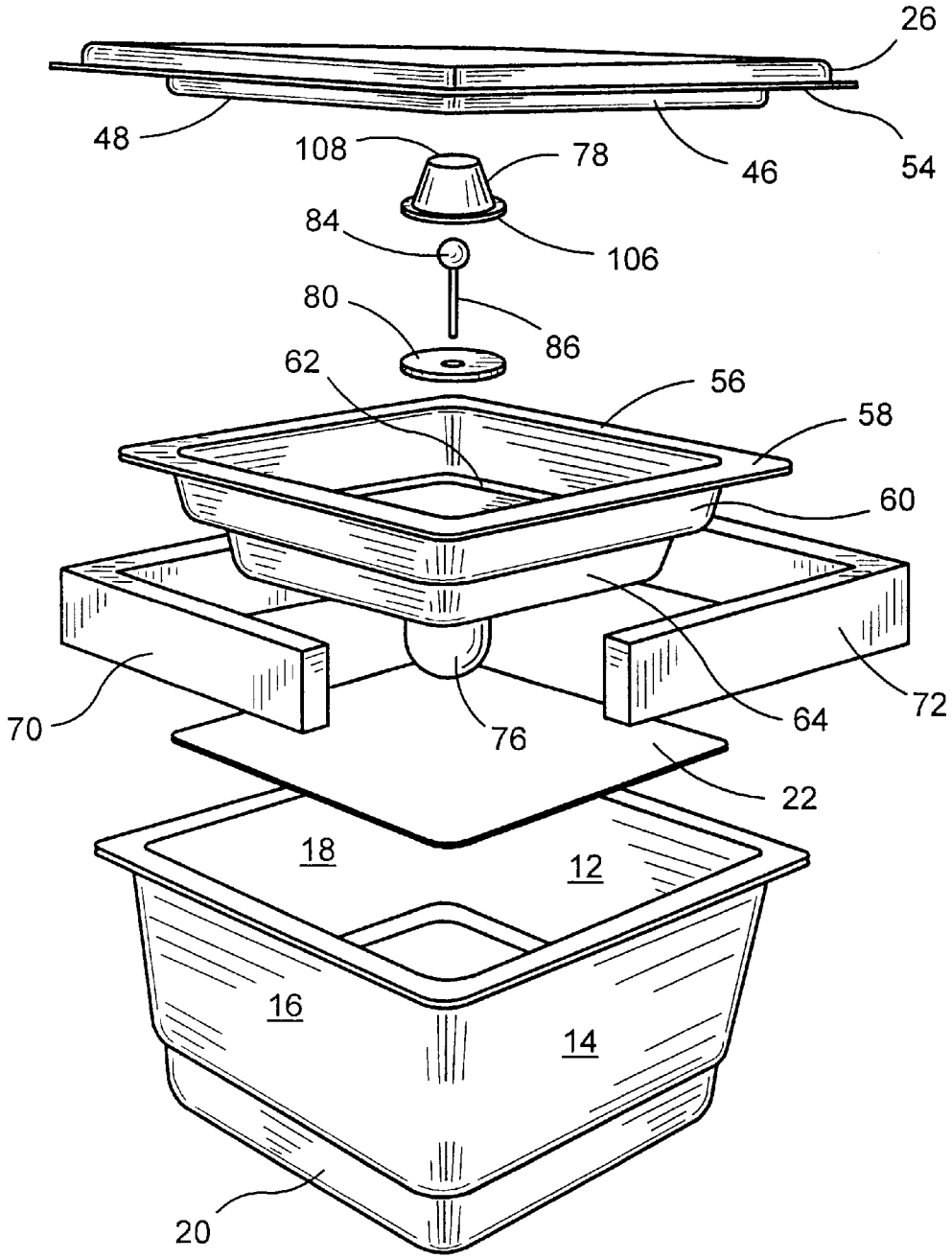
FIG. 1 is an exploded view of a storage container according to the invention.

Turning now to the drawings wherein like numerals refer to like parts throughout, FIG. 1 depicts a container for transporting and storing temperature-sensitive materials, said container being generally identified by the numeral 10. Although, container 10 can be of a triangular, rectangular, circular or other construction, for purposes of the present invention, the preferred container shape for description will be essentially rectilinear.

In accordance with the present invention and FIG. 1, walls 12, 14, 16, and 18 are integral and in communication with each other and base 20. The resulting preferred assemblage is essentially box-shaped, being closed on the bottom end by base 20 and open on the opposing end.

Figure 2:
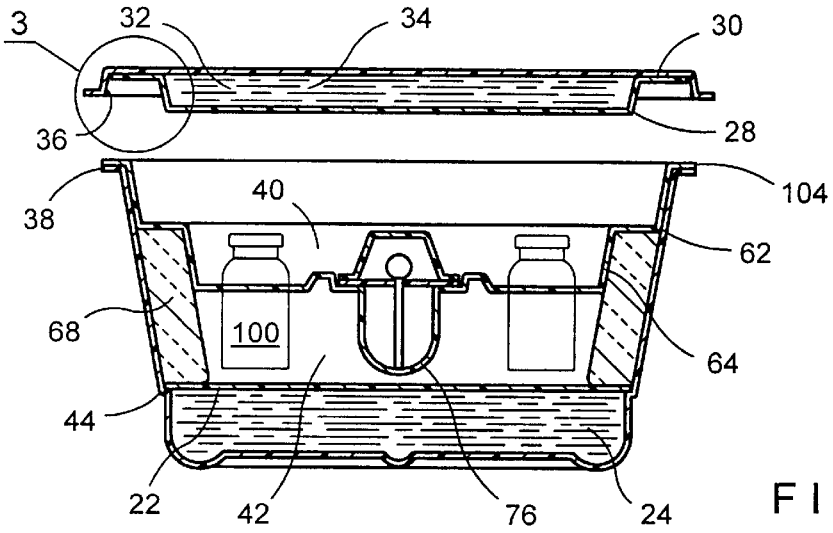
FIG. 2 is a plan view of the container of FIG. 1 with a lid of the container partially cut away to reveal an inner vial holder.
Figure 3:
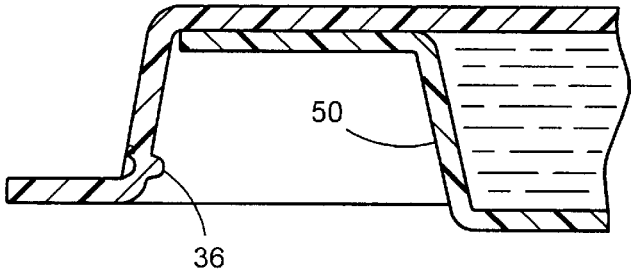
FIG. 3 is an elevational view in cross section taken along line 3—3 of FIG. 2.

Turning to FIG. 2, base 20 is of a reduced dimension there-around, in relation to upstanding walls 12, 14, 16, 18, and at its meeting point provides shoulder 44. Panel 22 is in communication with base 20 at shoulder 44 and may be hermetically affixed thereon. The cell created by the aforesaid union provides a receptacle for a first heat sink 24.

The tops of each wall 12, 14, 16 and 18 terminates in an outwardly projecting flange area 38. Pursuant to FIGS. 1&2, lid 26 is adapted to close container 10 by nesting within the open end of said container 10 and by reversible interlocking engagement between flanges 36 and 38. Lid 26 is further comprised of panel 28 which is in integral communication as by being hermetically affixed to upper lid surface 30 and provides a cavity 32 for second heat sink 34. Second heat sink 34 projects downward and thereby furnishes an indented area of approximately the same dimensions as the opening formed by upstanding walls 12, 14, 16, 18 of container 10 to effect closure by nesting and interlocking engagement thereto.

For purposes of the present invention, differences in outside temperature will act upon a container by virtue of the phenomena of heat transfer. Heat is energy that flows, by virtue of a temperature differential, from regions of higher temperature to lower temperature. The various modes of heat transfer are by conduction, radiation and convection. In the instant regard, the greatest change in sample temperature occurs as a result of conduction.

Conduction takes place on the molecular level and involves the transfer of energy from more energetic molecules to molecules possessing less energy. Hence, the closer the molecules are to one another, the greater the incidence of collision and transfer of energy. Conduction would be greater where molecules touch each other and significantly less as the density of molecular space increases. Heat flux, or the rate of heat flow from greater temperature to lower temperature, is therefore proportionate when taken in view of the thermal conductivity of the material.

In addition, there are yet other phenomena that exist when one speaks in terms of heat transfer. Where there are different species of chemically distinct molecules there exists a concentration gradient. The term mass transfer describes the relative motion of species in a mixture due to the presence of concentration gradients. Heat will move across the gradient from areas of greater concentration to lesser concentration.

Radiation, or more appropriately in terms of the instant case, thermal radiation is electromagnetic radiation emitted by a body by virtue of its temperature and at the expense of its internal energy. Unlike conduction, radiation does not require a material medium.

Finally, the container when exposed to the vagaries of shipping will be exposed to convection. Although the sample itself will be almost immune from the direct effect of the outside convective force, the environment inside will not. Convection, as a transfer mode relates to the transfer of heat from a bounding surface to a fluid in motion or to the heat transfer across a flow plane within the interior of the flowing fluid. Mainly, the phenomenon requires the flow of a fluid or gas over a surface. When the container is exposed to the elements, as during shipping or upon exposure to ambient conditions, air currents outside the container will act upon the container encouraging changes in temperature within the container. Inside the container, the vibratory motion encountered during transportation will encourage heat transfer and temperature change, as will natural convection currents produced by the inherent temperature differential within the container.

In the preferred embodiment as shown in FIG.2, there are two heat sinks 24 and 34. Heat sinks 24 and 34 cooperate to provide a media to absorb increases or decreases in temperature within bottom chamber 42 and top chamber 40. For purposes of the present invention, the preferred heat sink material is a phase change material. As a class, phase change materials can absorb a tremendous amount of heat energy in their transition between phases. When maintained in a frozen state, the product of net specific heat and density would represent an inverse logarithmic relationship. For example, once the material which has been in a frozen condition reaches the point of freeze/thaw, the temperature remains substantially constant until complete melting occurs. Maintaining a temperature plateau allows for great amounts of heat to be absorbed at a constant rate, and encourages maintenance of a constant ambient interior container temperature. Therefore, heat sinks 24 and 34 are preferably constructed from a phase change material such as carboxymethylcellulose gel, having a freezing temperature of approximately −1° C. It should be noted that most phase change materials like carboxymethlycellulose are relatively poor insulating materials. Other materials for constructing heat sinks are phenols, salts, water, glycols, starches and alcohols.

Heat sinks 24 and 34 preferably exhibit a phase change at a temperature slightly above the freezing temperature of the liquid contained within vials 100. Thus, when container 10 is exposed to a temperature below the freezing temperature of the liquid in vials 100, a large quantity of heat energy relative to the mass of the phase change material within heat sink 24 and 34 must be dissipated to the external environment before the temperature of the heat sinks 24 and 34 will fall below the freezing temperature of the liquid in the vials 100. Heat sinks 24 and 34 thus provide a thermal damping effect against temperature changes in the environment of the container 10. In accordance with the present invention, using a total weight of carboxymethylcellulose of 6.5 ounces, container 10 should resist 8 hours of exposure to a −20-degree Celsius external temperature.

As described hereinabove, the heat sink material may be chosen from a variety of materials, based on their freezing point and the desired temperature at which the sample is to be maintained. For example, many alcohols or glycols are particularly suited for maintaining sub-ambient interior temperatures. Alcohols, glycols or any compound that has an extremely low freezing point, once frozen, requires a great amount of heat to raise their temperature above its freezing point and the freezing point of a biologic sample.

Returning to the preferred embodiment of FIGS. 1 and 2 base 12 is substantially equilateral and square in overall shape, having walls 12, 14, 16, and 18 integrally connected thereto by hermetically sealed or thermo-formed. Panel 22 is in communication with the aforesaid walls and is joined at a lower portion 24. At their lower extent, the walls 12, 14, 16, 18, extend inwardly to form support lip 44 which supports panel 22. A well formed within the boundaries of panel 22 and base 20 contains a first heat sink 24.

First and second heat sinks 24 and 34 may be retained within a well or envelope formed by hermetically sealing panels or sides to each other. Various other embodiments or materials could be operatively substituted. For example, solids like dry-ice or frozen aqueous solutions which remain solid through their "phase change" would obviate the need for encapsulating a gel material. An indented base 20 lends a distinctive appearance to container 10 as well as providing greater stability. The material contained within base 20 provides sufficient weight to encourage maintenance in an upright position.

Figure 8:
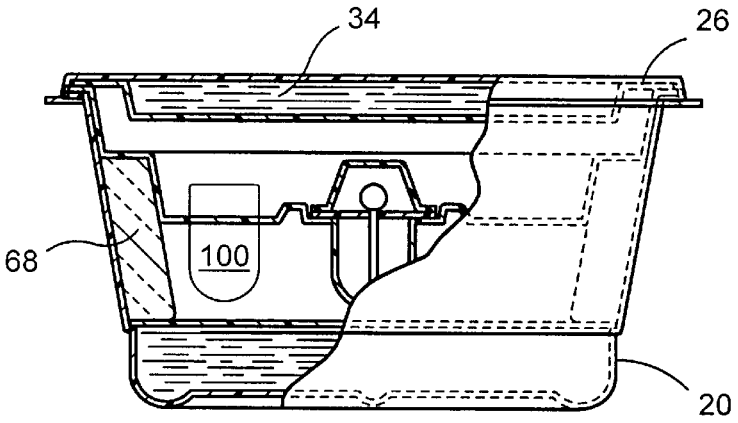
FIG. 8. is an elevational view in cut-away of the container in a closed condition.
Figure 10:
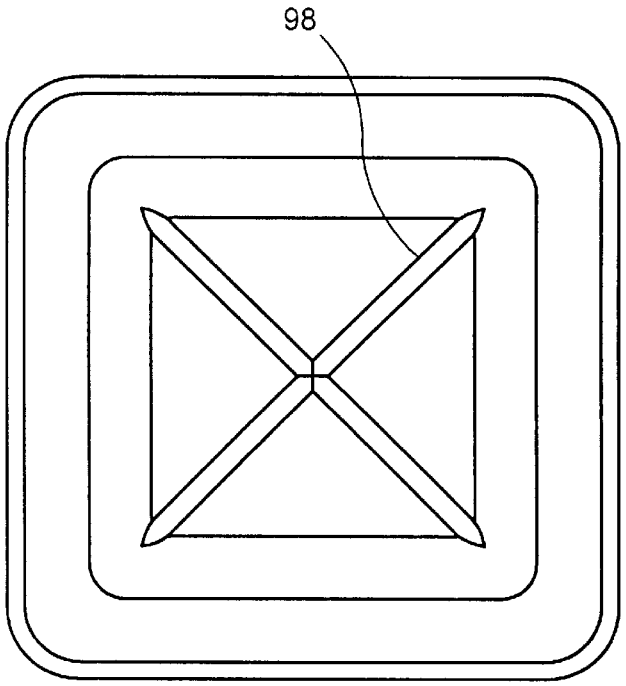
FIG. 10 is a bottom plan view depicting the reinforcing ribs.
Figure 9:
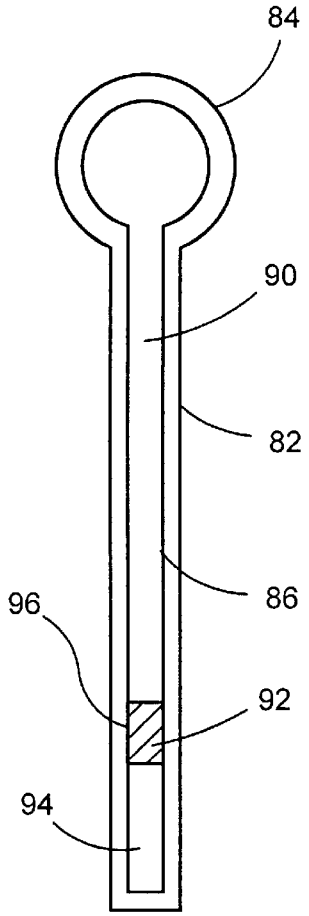
FIG. 9 is a cross-sectional view of the container of the capillary tube and bulb.
Figure 11:
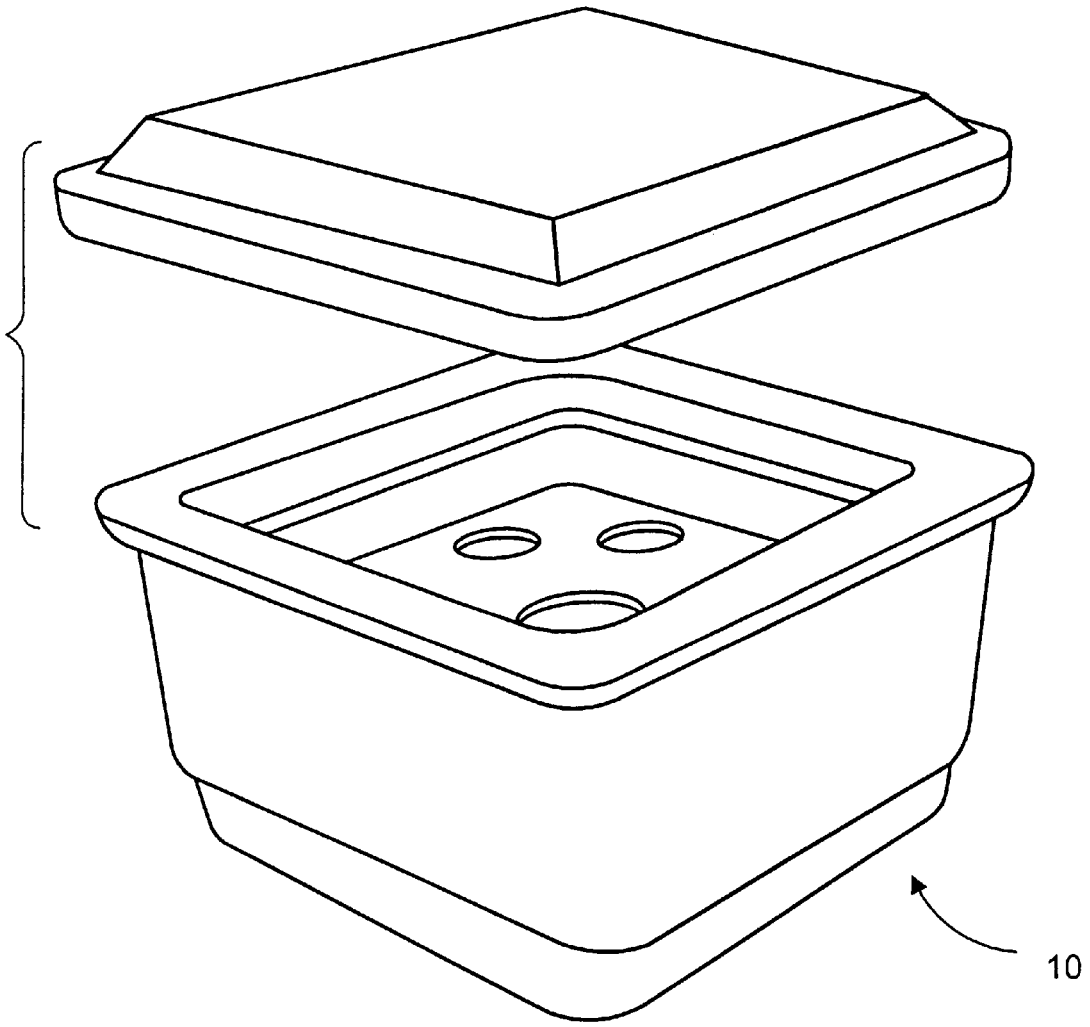
FIG. 11 is a perspective view of the container.

Walls 12, 14, 16, 18, base 20 and panel 22 are preferably formed from a thermoplastic polymer component like polyvinyl chloride, PETG or a similar thermoplastic polymer. When constructed as by injection molding or by another thermo-forming method said walls 12, 14, 16, 18 and base 20 are integral. Panel 22 is preferably hermetically affixed to outstanding lips 44 so that first heat sink 24 may be disposed therein. Lid 26 is fashioned from the same polymer as panel 28, and upper lid panel 30 communicate to form downward depending well 32. Lid 26 provides downwardly depending sides 46, 48, 50, and 52 and flange 36 which reversibly communicates with flange 38 of wall 12, 14, 16, and 18 thereby encouraging closure of container 10 as seen in FIGS. 8 and 2.

Downward depending well 32 corresponds to the inside dimension of open container 10 as defined by inner wall surfaces of vial holder 56 and nests therein to accomplish closure while discouraging lateral movement. To effect closure of container 10, lid 26 reversibly nests within the space defined by upstanding walls 12–18, and upward disposed flange 38, in accordance with FIG. 2, extends outwardly radially from the upper extent of the sidewalls. A downwardly disposed flange 36 extends downwardly from outer edges 54 of upper panel 28 of the lid 26. Upper flange 36 and downward flange 38 engage each other to hold the lid 26 in a reversibly interlocked condition. A detente or interlocking members (not shown) may be provided on either the downward flange 36 or upper flange 38 to more securely attach the lid 26. Preferably, upper panel 28 and the downward flange 36 are formed as a single thermo-formed plastic part.

Walls 12, 14, 16, 18 and lid 26 are the first barrier to prevent temperature changes within the container. The thermoplastic polymer is non-porous, insulating and retards heat transfer. Therefore, depending on the thickness of the polymer there will be an insulating or "R" factor, while the material itself will by definition facilitate or retard heat transfer by virtue of its "K" factor. Not only does the non-porous material prevent radiation but also the inherent insulation rating of the material itself heat transfer through conduction. Finally, heat loss from convection caused by air passing over the non-porous outer skin of the container greatly reduces heat transfer within the container.

Vial holder 56 possesses a step-shaped appearance and contains peripheral ledge 58 which creates a horizontal surface to abuttingly retain insulating insert 68, said ledge approximates the width dimensions of the upper surface of insulating insert 68, and is secured thereon. Surfaces 58, 60, 62,64 depend substantially inward and downward from an outer edge flange 104 of vial holder 56 and terminates in an outwardly extending flange 38. Vial holder 56 and outer edge flange 104 rests atop insulating insert panel 68, and walls 12, 14, 16, 18. Preferably, vial holder 56 is formed from a single piece of plastic in a thermo-forming operation and communicates with sidewalls 12–18, insulating insert 68 and flange 38 being hermetically affixed thereon. Further, vial holder 56 divides container 10 into a top chamber 40 and bottom chamber 42.

As shown by FIGS. 1 and 2 depict placement of insulating insert 68 which is immovably retained adjacent to the inner surface of walls 12, 14, 16 and 18 by vial holder 56. As best seen in FIG. 2, surfaces 62 and 64 extend over and abut insulated insert 68. Surface 62 and surface 64 conform dimensionally to insulated insert 68 and immovably retain said insulated insert in position around the inside of walls 12, 14, 16, and 18. Overall both insert members 70 and 72 and surfaces 62 and 64 are angled sufficient to constitute mating as seen in FIGS, 2 and 8. Insulated insert 68 is preferably comprised of two L-shaped members 70 and 72 which abut one another. Insulated insert 68 is thus held securely between the lower panel 22, sidewalls 12, 14, 16, 18 and vial holder 56, and is preferably hermetically affixed or sonically welded within. Other means of affixing by the use of adhesives or by thermo-forming procedures may be substituted.

Insulating insert 68 contributes a shock absorbing component to the assemblage. Insulating insert 68 when derived from the preferred material, a closed cell foam like polyvinyl chloride, urethane or PETG, or other closed cell polymer insulator, absorbs shock waves by the inherent memory of the polymer. Not only is mechanical damage to the vials prevented, but also convection within the chamber is discouraged. Vial holder 56 is preferably formed of a single piece of plastic in a thermo-forming operation.

Figure 7:
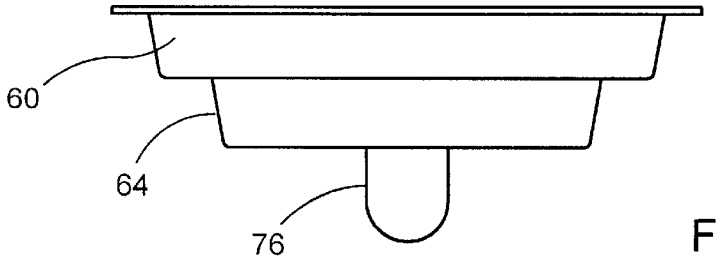
FIG. 7 is an elevational view of the vial holder.

In accordance with FIG. 7 a series of buttresses or support struts 98 are disposed on the bottom of base 20. Struts 98 prevent deformation of the container caused by expansion of the gel of heat sink 24. Therefore, struts 98 prevent a bowing outward from the bottom of container 10, while providing overall rigidity to retard outward expansion of base 20. While the preferred embodiment is X-shaped, struts which encourage container support and structural integrity may be operatively substituted.

Figure 5:
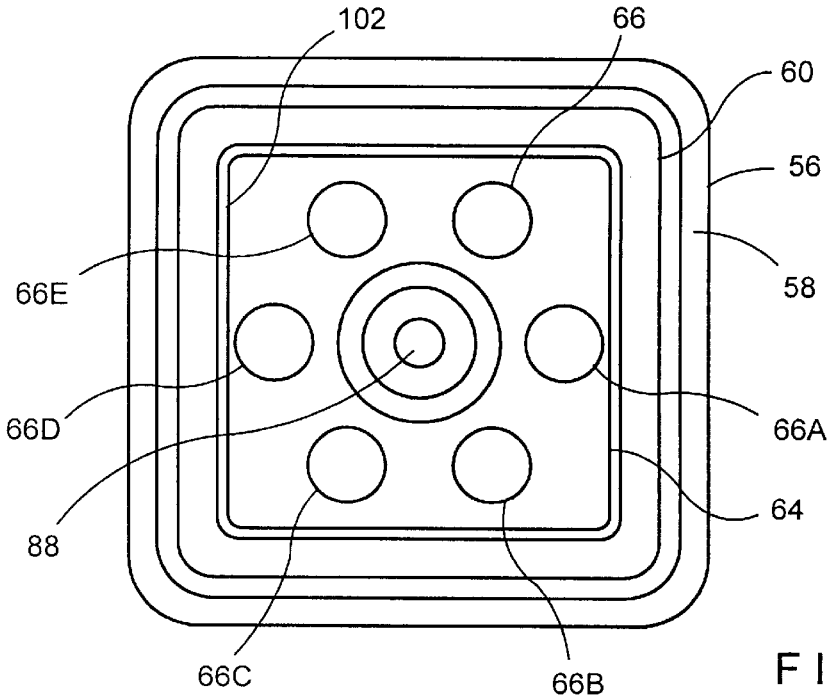
FIG. 5 is a top plan view of the container in an opened condition.
Figure 6A:
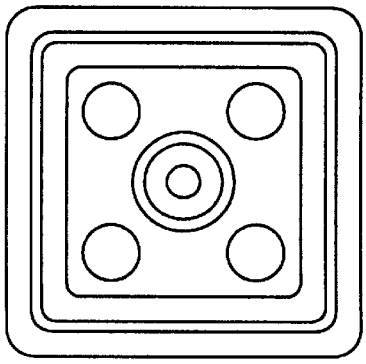
FIG. 6A is an alternate top plan view thereof.
Figure 6B:
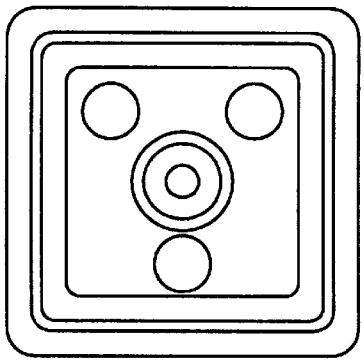
FIG. 6B is an alternate top plan view thereof.

The preferred representation of vial holder 56, as illustrated by FIGS. 5 and 6, is further comprised of a series of descending surfaces. Hence horizontal peripheral ledge 58 descends via vertical wall 60 to slanted surface 62 which in turn and in a step-wise relation descends via wall 64 to planar surface 102. Planar surface 64 resides above the panel 22. Said planar surface 102 contains a plurality of apertures 66*a–f* adapted to receive a like number of vials therethrough. A central aperture 88 furnishes said plurality of apertures 66*a–f* a point for their arrangement in equidistant relation thereto. In accordance with FIGS. 5, 6A and 6B the overall disposition of apertures is in a circular pattern around central aperture 88. Therefore, notwithstanding the geometric figure which results, an infinite number of points which are equidistant to a central point or in circular arrangement may be operatively substituted. A further advantage inherent to the equidistant arrangement is that the vials will undergo equal cooling.

Central aperture 88 is adapted to receive temperature indicator 74. Central aperture 88 is of a reduced diameter and is adapted to receive capillary tube 86 of stem 82 and prevents bulbous portion 84 from falling therethrough. Temperature indicator 74 is assembled as a unit with dome 78 interlocking with retention ring 80 thereby preventing stem 82 and bulbous portion 84 from ejecting upward and outward therefrom.

In the preferred embodiment, panel 102 possesses an aperture centered on said panel and a plurality of apertures 66*a–f* which is adapted to receive a like number vials 100 of medicaments, as seen in FIGS. 5, 6A and 6B. Said vials 100 are retained within said apertures 66*a–f*.

FIGS. 2 and 8 show container 10 in an assembled condition, vial holder 56 and vials 100 are so situated within chambers 40 and 42 and above panel 22 and below panel 28 or above first heat sink 24 and below second heat sink 34, so that vials 100 placed in apertures 66*a–f* are held suspended within bottom chamber 42. Vials 100, thus positioned, are substantially spaced from the sidewalls 22 and are positioned above the first heat sink 14.

Entrapped gases which, by definition, possess a random molecular configuration, are excellent insulators. Lid 26 and base 20 defining the uppermost boundaries of top and bottom chambers 40 and 42 may contain an insulating gas, in this case air, to insulate vials 100 from the vagaries of the exterior environment. Heat sinks 24 and 34 and the carboxymethylcellulose contained therein conducts heat from the vials faster than air. Thus, by not directly embedding the vials within the gel, heat loss from the vials is reduced.

Figure 4:
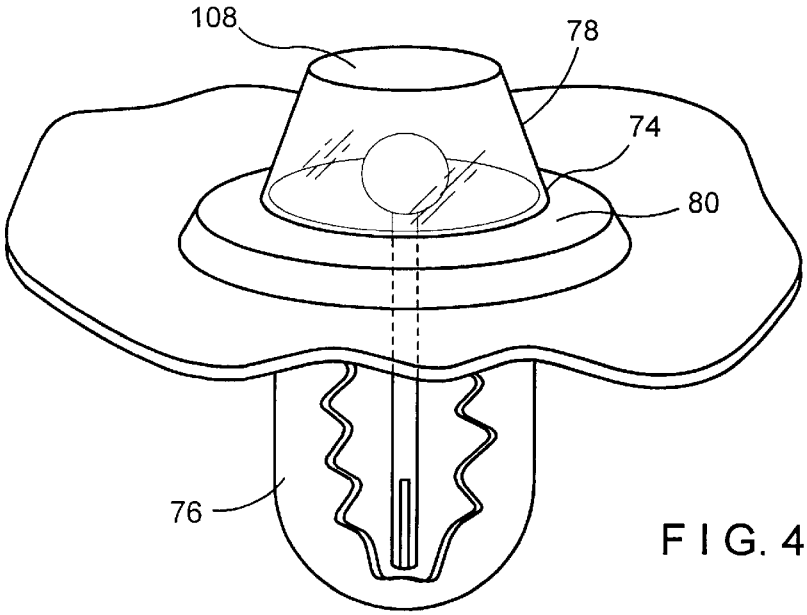
FIG. 4 is an elevational view as a partial cut-away thereof.

Turning to FIGS. 1 and 4, temperature indicator 74 resides within central aperture 88. Temperature indicator 74 comprises a casing 76 of approximately the same dimensions as vials 100*a–f* to be retained within apertures 66*a–f* and having an outwardly extending outer edge flange 104 at its upper extent. Flange 104 attaches to or is integral with panel 102 of vial holder 56 and surrounds a central aperture of reduced circumference 88. Casing 76 thus depends beneath the panel 102.

A clear dome cover 78 fits over casing 76. It has an outwardly extending radial flange 106 which attaches to panel 102 of vial holder 56 and adjacent the cylindrical casing flange 104. An upper surface 108 of dome cover 78 is preferably planar and imprinted with a warning regarding the color change of the indicator and including a toll-free number which a user may call for information regarding proper use of container 10 (see also FIG. 2).

Disk-shaped divider 80 fits between casing 76 and dome cover 90. A central aperture of reduced diameter 110 in divider 80 receives elongated ampule 82. Bulbous portion 84 of ampule 82 at an upper end of ampule 82 is larger than the divider aperture 110 whereby the ampule 82 is supported upon divider 80 and held secure by dome cover 78. Ampule 82, casing 76 and dome cover 78 are dimensionally similar so that when assembled, ampule 82 cannot move up and out of divider 80 through aperture 88, even if the container 10 is completely inverted. Also, temperature indicator 74 is preferably permanently attached to the vial holder 56 so that vials 100 cannot be shipped or stored without said indicator 74.

Turning to FIG. 4, bulbous portion 84 of temperature indicator 74 contains a clear fluid 90 which contracts upon freezing, preferably, a mixture of 75% octyl caprate and 25% hexyl laurate. Temperature indicator 74 further comprises a capillary stem 100 and the clear fluid 90 extends partially into the stem 86. Stem 86 contains a liquid barrier chemical 92, preferably ethylene glycol AR grade and green food dye, adjacent the clear fluid 90. A violet liquid 94, preferably a mixture of 98% iso-amyl laurate and 2% waxoline violet BA dye, is contained within the stem 86 on an opposite side of the barrier chemical 92.

Barrier chemical 92 tends not to mix with either the clear fluid 90 or the violet liquid 94 and thus keeps the violet liquid 94 out of the bulbous portion 84. The capillary nature of the stem 86 also prevents the layers 90, 92 and 94 from mixing. However, when the clear liquid 90 freezes, it contracts and pulls the violet liquid 94 into the bulbous portion where it irreversibly mixes with the clear liquid 90 to produce a noticeable color change therein. The divider 96 is preferably white or another light and contrasting color so that the color change is easily visible.

Alternatively, a temperature indicator can be provided which contains a frangible ampule (not shown, but as is well known in the art) which breaks upon the freezing and expansion of a liquid contained within the ampule. Preferably, an indicator sensitive to the liquid is provided to show a color or other change indicating that the ampule has broken. To improve the accuracy of such an indicator, the liquid may comprise a placebo preparation of the liquid contained within vials 100.

Yet another aspect of the present invention is clear from FIG. 2 which illustrates that the temperature indicator itself can be retained in a vial-shaped holder having substantially the same structure and properties as the vials holding the active contents. By providing apertures to retain vials in a substantially equidistant relationship, and a fluid or gas between the vial-shaped holder and the temperature indicator, so that theh temperature indicator suffers a similar temperature differential as the vials carrying the active contents. Unlike the prior art which teaches in-line disposition of its contents, the instant invention will provide a true reading of temperature ranges which may affect the vials.

Should vials 100 stored in container 10 be exposed to ambient temperature conditions sufficient to overcome the insulating and thermal moderating effect of the container 10, clear liquid 90 will freeze and trigger the color change within temperature indicator 74. By simply opening lid 26 of container 10, a user will thus be alerted to the possibility that the contents in vials 100 have been exposed to temperatures below their freezing point or above the temperature necessary to maintain stability. Preferably, the temperature which triggers the visual indicia of temperature indicator 74 should be slightly above the freezing point of the liquid or slightly below the temperature necessary to maintain stability of the substance in vials 100. Moreover, the choice of a phase change material for heat sinks 24 and 34 can be chosen from the groups listed hereinabove to suit the temperature range of temperature indicator 74.

While the invention has been particularly described in connection with specific embodiments thereof, it is to be understood that this is by way of illustration and not of limitation, and that the scope of the appended claims should be construed as broadly as the prior art will permit.

What is claimed is:

1. A container for objects susceptible to damage upon changes in temperature comprising:

a. an enclosure having a lower portion, a top portion and a side portion between the lower and top portions thereby defining an inner space;

b. a first heat sink in the enclosure;

c. a holder means in the inner space for holding at least one of said objects at a predetermined location in the inner space;

d. an indicator in the inner space for indicating that said inner space has been subjected to temperatures above or below a predetermined temperature; and e. an open space filled with a gas and extending between the indicator and the predetermined location, whereby the indicator is subjected to substantially the same temperatures as the predetermined location.

2. A container according to claim 1 wherein the holder means is adapted to hold a plurality of said compositions at a plurality of determined locations, the indicator is located centrally of the predetermined locations.

3. A container according to claim 2 wherein the open space extends between each of the predetermined locations and the indicator.

4. A container according to claim 3 wherein the predetermined locations are substantially equidistant from the indicator.

5. A container according to claim 1 wherein the heat sink comprises a substance which exhibits a phase change at a temperature slightly above the predetermined temperature.

6. A container according to claim 1 wherein a first heat sink is disposed substantially below the predetermined location whereby said holder means and composition is disposed substantially away from said heat sink.

7. A container according to claim 6 wherein the top portion contains a second heat sink is disposed substantially above the predetermined location whereby the holder means retains said objects, being disposed substantially below said second heat sink.

8. A container according to claim 1 wherein the holder means comprises a panel above the first thermal moderator, the panel having at least one aperture therethrough for receiving at least one of the objects.

9. A container according to claim 4 wherein the panel is thin and planar.

10. A container according to claim 1 wherein the predetermined location is placed from the side portion and the gas is also disposed between the predetermined location and the side portion.

11. A container according to claim 1 wherein said heat sink further comprises an energy absorbing substance that exhibits a phase change at a temperature slightly above or below a predetermined temperature.

12. A container according to claim 1 wherein said heat sink further comprises a phase change substance selected from the group consisting of carboxymethylcellulose, starch, alcohols, phenols and water.

13. A container according to claim 1 wherein said heat sink is carboxymethylcellulose and water.

14. A container according to claim 1 wherein said lid is adapted to receive a second heat sink and wherein said second heat sink further comprises an energy absorbing substance that exhibits a phase change at a temperature slightly above or below a predetermined temperature.

15. A container according to claim 1 wherein said second heat sink further comprises a phase change material chosen from the group consisting of carboxymethylcellulose, phenols, alcohols, water, and starch.

16. A container according to claim 1 wherein the plate means comprises a panel above the first heat sink, the panel having at least one aperture therethrough adapted to receive at least one of said vessels.

17. A container according to claim 1 wherein the plate means comprises a panel located above the first heat sink, the panel having a plurality of equally spaced apertures therethrough for receiving a like number of said vessels.

18. A container according to claim 1 wherein the panel is thin and planar.

19. A container according to claim 1 wherein a plurality of apertures are arrayed in equidistant relation to a central aperture.

20. A container for transporting and storing vessels containing a composition susceptible to physicochemical alteration upon changes in temperature comprising:

a. a plurality of upstanding walls integral with a base and forming an inner space closed on one end and open on the other;

b. a first heat sink disposed within said base;

c. a lid adapted to nest within said open end formed by said upstanding walls;

d. a second heat sink disposed within said lid;

e. an insulating insert disposed alongside the inner surfaces of said upstanding walls;

f. a plate disposed on said insulating insert thereby dividing said container into a top chamber and a bottom chamber, said plate means possessing a center point and an aperture therethrough, and a plurality of apertures in equidistant relation there around, said apertures adapted to removably retain a like number of vessels therethrough and to suspend said vessels within said bottom chamber above said insulated base and spaced away from said insulating insert;

g. an insulating gas surrounding said vessels and substantially filling the top and bottom chambers; and h. a temperature indicator disposed within the center aperture for indicating that the inner space has been subjected to temperatures either above or below a predetermined level.

21. A container according to claim 20 wherein said heat sink further comprises a material that exhibits a phase change at a temperature slightly above or below a predetermined temperature.

22. A container according to claim 20 wherein said heat sink further comprises an phase change material selected from the group consisting of carboxymethylcellulose, alcohols, phenols, starches, and water.

23. A container according to claim 20 wherein said heat sink is comprised of carboxymethylcellulose and water.

24. A container according to claim 20 wherein said lid is adapted to receive a second heat sink and wherein said second heat sink further comprises an energy absorbing substance that exhibits a phase change at a temperature slightly above or below a predetermined temperature.

25. A container according to claim 20 wherein said second heat sink further comprises an energy absorbing substance chosen from the group consisting of carboxymethylcellulose, phenols, alcohols, starches, and water.

26. A container according to claim 20 wherein the plate means comprises a panel above the first heat sink, the panel having at least one aperture therethrough for receiving at least one of said vessels.

27. A container according to claim 20 wherein the plate means comprises a panel located above the first heat sink, the panel having a plurality of equally spaced apertures therethrough for receiving a like number of said vessels.

28. A container according to claim 20 wherein the panel is thin and planar.

29. A container according to claim 20 wherein a plurality of apertures are arrayed in equidistant relation to a central aperture.

30. A container according to claim 20 wherein the array of apertures is circular around said central aperture.

31. A container according to claim 20 wherein the array of apertures is square around said central aperture.

32. A container according to claim 20 wherein the array of apertures is triangular around said central aperture.

33. A container according to claim 20 wherein the array of apertures circumscribes a figure which is equilateral.

34. A container according to claim 1 wherein the temperature indicator further comprises:

a. a dome;

b. a divider ring;

c. a casing means closed on the bottom thereof so that the overall shape of said tube approximates the size and shape of said vessels to be contained Within a vial holder;

d. a tube containing a material that when exposed to temperatures above or below a specified temperature the change will be visible.

35. A temperature indicator according to claim 34 wherein said tube further comprises a capillary tube open on one end with a bulbous portion on the other.

36. A temperature indicator according to claim 34 wherein said tube further comprises a capillary tube open on one end with a bulbous portion on the other wherein said article is frangible.

37. A temperature indicator according to claim 34 wherein an indicator undergoes a color change when exposed to changes in temperature.

* * * * *